US006378764B1

(12) United States Patent
Teixidor Casanovas

(10) Patent No.: US 6,378,764 B1
(45) Date of Patent: Apr. 30, 2002

(54) TRAY FOR TRANSPORTING PRODUCTS, AND METHOD FOR ITS FABRICATION

(75) Inventor: Pere Teixidor Casanovas, Barcelona (ES)

(73) Assignee: Videcart, S.A., Ibiricu de Egues (ES)

( * ) Notice: Subject to any disclaimer, the term of this patent is extended or adjusted under 35 U.S.C. 154(b) by 0 days.

(21) Appl. No.: 09/529,066

(22) PCT Filed: Oct. 5, 1998

(86) PCT No.: PCT/ES98/00272

§ 371 Date: Apr. 6, 2000

§ 102(e) Date: Apr. 6, 2000

(87) PCT Pub. No.: WO99/17995

PCT Pub. Date: Apr. 15, 1999

(30) Foreign Application Priority Data

Oct. 7, 1997 (ES) ..... 9702081

(51) Int. Cl.[7] ..... B65D 5/20; B65D 21/032; B65B 43/26

(52) U.S. Cl. ..... 229/191; 206/509; 206/512; 229/199; 229/918; 493/128; 493/129; 493/162

(58) Field of Search ..... 229/117.07, 117.08, 229/191, 199, 915, 918; 206/509, 512; 493/128, 129, 162, 311

(56) References Cited

U.S. PATENT DOCUMENTS

| | | | | | |
|---|---|---|---|---|---|
| 3,034,698 | A | * | 5/1962 | Forrer | 229/918 |
| 3,375,967 | A | * | 4/1968 | Robinson | 229/191 |
| 4,799,620 | A | * | 1/1989 | Vilella | 206/509 |
| 4,860,948 | A | * | 8/1989 | Hofstede | 229/199 |
| 5,535,941 | A | * | 7/1996 | Garza | 229/191 |
| 5,992,735 | A | * | 11/1999 | Oosterbaan | 229/191 |

FOREIGN PATENT DOCUMENTS

| | | | | |
|---|---|---|---|---|
| EP | 76883 | A1 | * 4/1983 | |
| FR | 1221861 | A | * 6/1960 | |
| FR | 2267255 | A1 | * 11/1975 | |
| GB | 893562 | A | * 4/1962 | |
| GB | 910844 | A | * 11/1962 | |
| GB | 911090 | A | * 11/1962 | |
| GB | 2157659 | A | * 10/1985 | |
| GB | 2205083 | A | * 11/1988 | 229/117.07 |

* cited by examiner

*Primary Examiner*—Gary E. Elkins
(74) *Attorney, Agent, or Firm*—Steinberg & Raskin, P.C.

(57) ABSTRACT

A tray for transporting products and a method for its manufacture, the tray being formed from a sheet of cardboard which is die cut and includes fold lines defining the bottom and sides of the tray. The tray includes a hollow corner column (5) into which a reinforcing element (6) is inserted.

15 Claims, 3 Drawing Sheets

TRAY FOR TRANSPORTING PRODUCTS, AND METHOD FOR ITS FABRICATION

The present invention relates to a tray for transporting products and the method for its manufacturing, the tray being formed from at least one sheet of cardboard or a similar material, previously die-cut and with fold-lines defining the bottom and the sides of the tray.

BACKGROUND OF THE INVENTION

At the moment different types of cardboard trays are known for the transportation of products. These well-known trays are formed from a die-cut sheet and are provided with fold-lines that define the bottom and the sides of the tray.

To be able to stack the trays, these trays present columns of polygonal, usually triangular, cross section, at their corners that keep them straightened in work position. These columns are usually formed starting from a headwall that adheres to the smaller sides of the tray.

These well-known trays have the main drawback that they occupy a considerable amount of space when they are transported empty.

To solve this problem the tray described in the utility model no. ES-U9201875 was devised, whose common features with the tray of the present invention are pointed out in the preamble of claim 1. This tray comprises a triangular column at each one of its corners and a reinforcement plate that is introduced in each one of these columns. It was thus possible to have a tray that could be transported folded, occupying a very small volume, and had sufficient rigidity to stack one box on top of another by fitting the reinforcement plate.

However, this tray presents the drawback that the reinforcing plate is not sufficient to support heavy weights. It also has the drawback that the tray has a given capacity, with no possibility of increasing it.

Furthermore, the methods for manufacturing this type of tray are carried out by shaping and gluing the parts of the tray in folded position, which has the drawback that said gluing is not very precise and has a width limit.

EP-A-0 076 883 discloses a blank of foldable sheet material, for erection into a container, which comprises a generally rectangular central portion for forming the base of the container and the panels hingedly connected along at least three edges of the central portion for erection to form side walls of the container, at least one of the panels being provided with a flap having at least one fold line which extends substantially parallel to the hinge, whereby the flap may be folded to form a load-bearing corner strut which can be located within the base of the container, when the container is erected.

GB-A-91044 discloses a tray for soft fruit, formed from a sheet of cardboard, previously die-cut and with fold-lines that define the bottom and the sides of the tray, with each one of the corners of same comprising a column of triangular cross section into which a reinforcing element of triangular cross section is inserted. One of the sides of the triangle defined in the columns has a double layer.

DESCRIPTION OF THE INVENTION

With the tray and the method of the invention the aforesaid drawbacks are solved, while other advantages are presented that will be described below.

The tray for the transportation of products of the invention is characterised in that said reinforcing element has a cross section equivalent to the cross section of the column, so that said reinforcing element fits inside the column.

Thanks to this characteristic a tray is provided that may be transported folded, occupying a small space and capable, moreover, of withstanding considerable weights by placing the reinforcing element in the columns.

Advantageously, the reinforcing element is formed from a sheet, with this sheet folded so that one of its sides is in contact with one of the vertexes of the polygon defined by the cross section of the reinforcing element.

According to a first embodiment, the height of the reinforcing element is substantially the same as the height of the column.

According to an alternative embodiment, the height of the reinforcing element is greater than the height of the column. It is thus easy to increase the capacity of the tray of the invention by increasing the height of the reinforcing element.

Also advantageously, each reinforcing element comprises at least one projection on its upper part that fits into a complementary cavity in the lower part of the reinforcing element when the trays are stacked, preventing the displacement of one tray with respect to another both longitudinally and transversally.

Preferably, each one of the columns includes at least one projection on its upper part that fits into a complementary cavity provided in the lower part of the tray when the trays are stacked.

According to a preferred embodiment, the reinforcing element comprises a double layer on each one of its sides.

Also according to a preferred embodiment, the reinforcing element includes three projections on its upper part, which fit into complementary cavities provided in the lower part of the reinforcing element when the trays are stacked.

Preferably, two opposing sides of the tray each include a pair of tabs which are inserted between the column and the reinforcing element. These tabs further reinforce the tray of the invention, since they prevent the ungluing of the smaller sides or headwalls. This feature is especially important because these trays are designed to transport considerable weights. It has been shown that without these tabs, the headwalls may be unglued, causing the break of the tray when the trays are transported individually.

Also preferably, the tray of the invention comprises prolongations on the sides of the tray that reinforce the column with an additional layer.

According to an alternative embodiment, the columns extend towards two opposite sides of the tray, reinforcing said opposite sides with a double additional layer.

The present invention also relates to a method for manufacturing trays for transporting products starting with at least one sheet of cardboard or similar material, characterised in that it includes the following stages:

- die-cutting of said cardboard sheet;
- formation of fold-lines on said sheet, defining a pair of side walls and a pair of headwalls and a column at each of the corners of the ready-formed tray;
- gluing of the columns;
- shaping the columns;
- gluing the side walls and the headwalls;
- folding the side walls and the headwalls;
- gluing of the external part of the columns which will be in contact with the headwalls;
- placing the side walls in vertical position;

placing a body inside the columns;

pressing the headwalls against the columns;

placing the reinforcing elements in unfolded position on the bottom of the tray;

folding the ready-shaped tray into its transporting position.

This method affords considerable precision in the gluing of all the parts of the tray, since the shaping is carried out in the definitive position and not in the folded position, as are currently manufactured all trays formed from cardboard sheets.

The method of the invention also permits the manufacturing of trays with no thickness limit. This is due to the shaping being carried out in their definitive position.

Preferably, after pressing the headwalls against the columns some tabs inserted between the column and the reinforcing element are folded inside the columns, and these will be inserted between the column and the reinforcing element in its definitive position.

If desired, before the gluing the zone to be glued can be treated, preferably by heating that zone, which will facilitate adhesion of the glue.

BRIEF DESCRIPTION OF THE DRAWINGS

For a better understanding of all that has been outlined some drawings are appended in which, schematically and only by way of non-restrictive example, a practical case of embodiment is shown.

DESCRIPTION OF A PREFERRED EMBODIMENT

Figure 1:
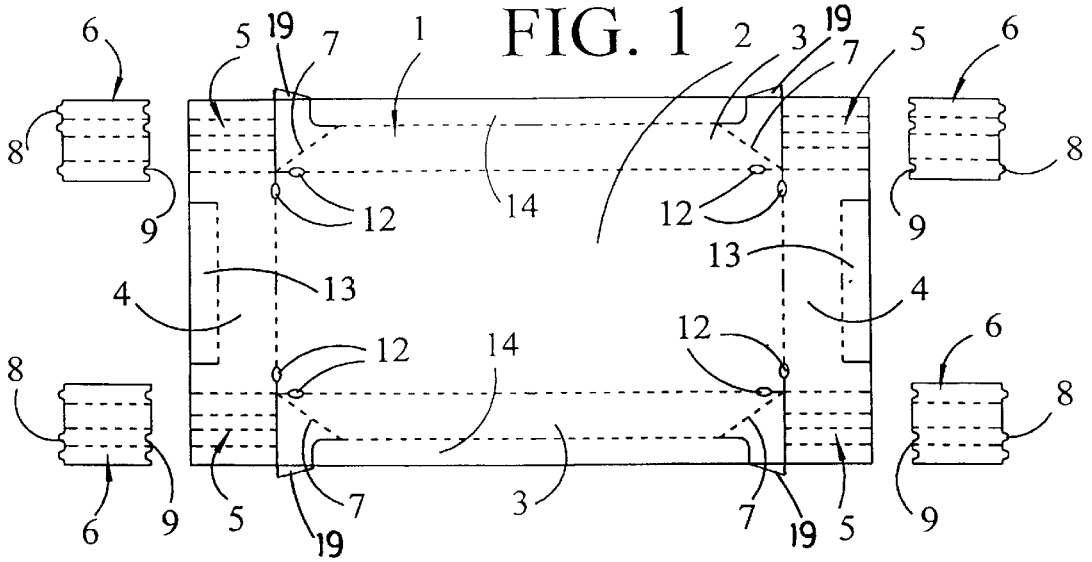
FIG. 1 is a plan view of the sheet that forms the tray of the invention according to a first embodiment of it, with the four sheets that will form the reinforcing elements inserted into the columns, which are also shown in plan view.

As shown in FIG. 1, the tray of the invention for transporting products is formed from a die-cut sheet of cardboard 1 provided with fold-lines. These fold-lines define the bottom 2 and the sides of the tray 3, 4.

Figure 2:
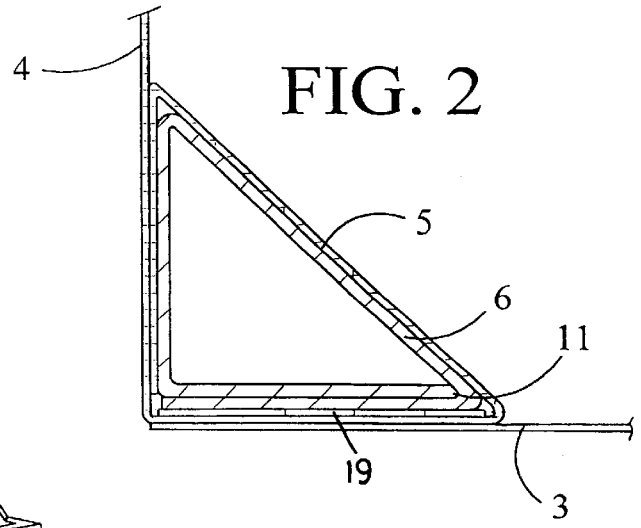
FIG. 2 is a plan view in cross section of one of the columns of a first embodiment of the tray of the invention, with the reinforcing element fitted inside it.

The smaller sides of the tray 4 (headwalls) have at their ends a number of fold-lines that define a column 5, as may be seen in FIG. 2.

Inside each column 5, of triangular cross section, is housed a reinforcing element 6 also of triangular cross section, so that it fits inside the column.

As may be seen in FIG. 1, each reinforcing element 6 is formed from a sheet provided with several fold-lines. In the embodiment shown, this reinforcing element 6 is of triangular cross section, with at least one of its sides presenting a double layer. Said sheet is folded in such a way that one of its sides is in contact with one of the vertexes 11 of the triangle defined by the cross section of the reinforcing element 6.

The reinforcing element 6 presents at least a couple of projections 8 on its upper part that fit into complementary cavities 9 provided in the lower part of the reinforcing element 6 when the trays are stacked. For this reason, the cardboard sheet 1 has some orifices 12 through which the aforesaid projections 8 pass. When the height of the reinforcing element 6 is substantially the same as the height of the column 5, the latter may also be provided with projections (not shown) that will carry out the same function as the projections 8 of the reinforcing element 6.

Figure 3:
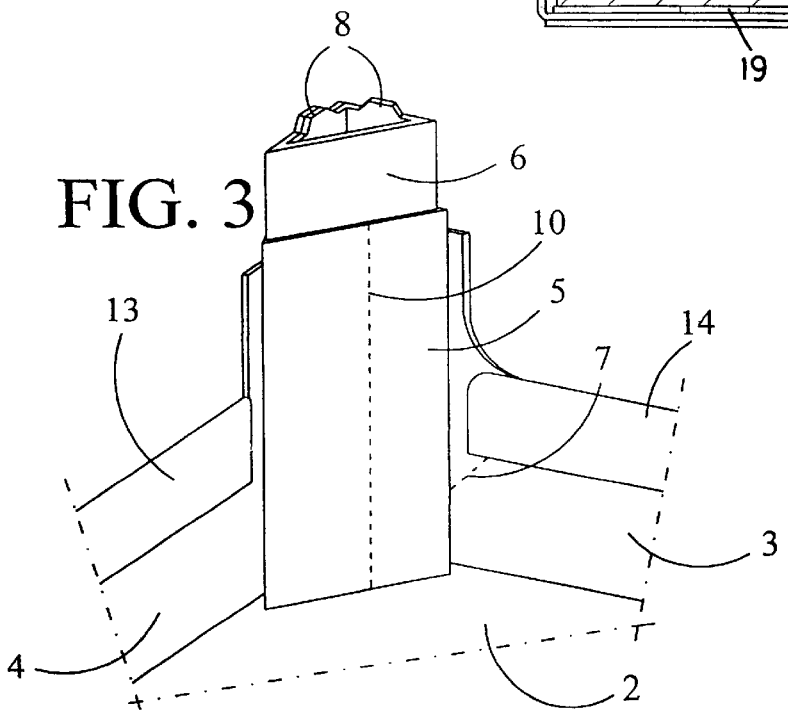
FIG. 3 is a perspective view of one of the corners of a first embodiment of the tray of the invention, showing the reinforcing element with a height exceeding the height of the column.

FIG. 3 shows an embodiment of the tray of the invention in which the height of the reinforcing element 6 is greater than that of the column 5. Although is not shown in the figure, in this case the reinforcing element 6 will preferably have a double layer on two of its sides or on three sides, so that it may support the weight of a tray stacked on top of it.

In order to facilitate the transportation of the empty tray, the tray is transported folded, without placing the reinforcing elements 6 inside the columns. The tray can be folded thanks to the presence of two fold-lines 7 provided on the two larger sides 3 of the tray. As FIG. 1 shows, the fold-lines 7 of each side 3 slope in opposite directions. To allow this folding, each of the columns 5 presents a vertical fold-line 10.

Figure 4:
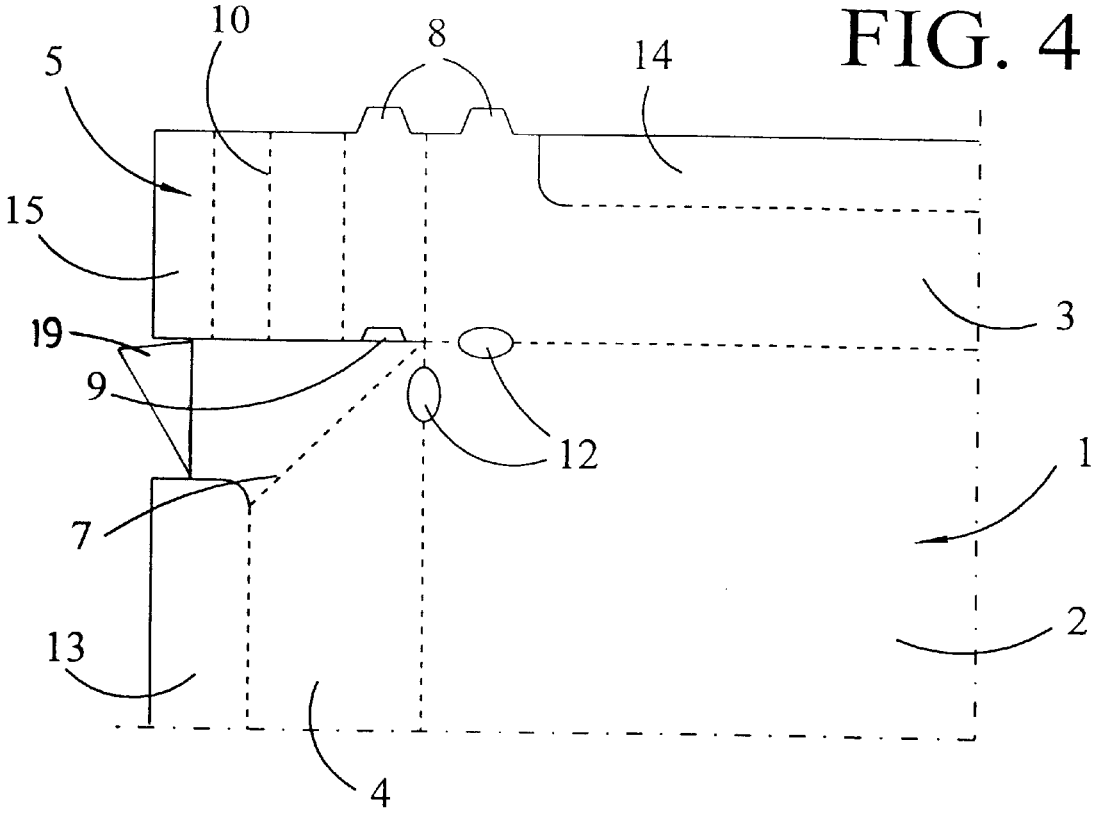
FIG. 4 is a plan view of a fourth part of the sheet that forms the tray of the invention according to a second embodiment.
Figure 5:
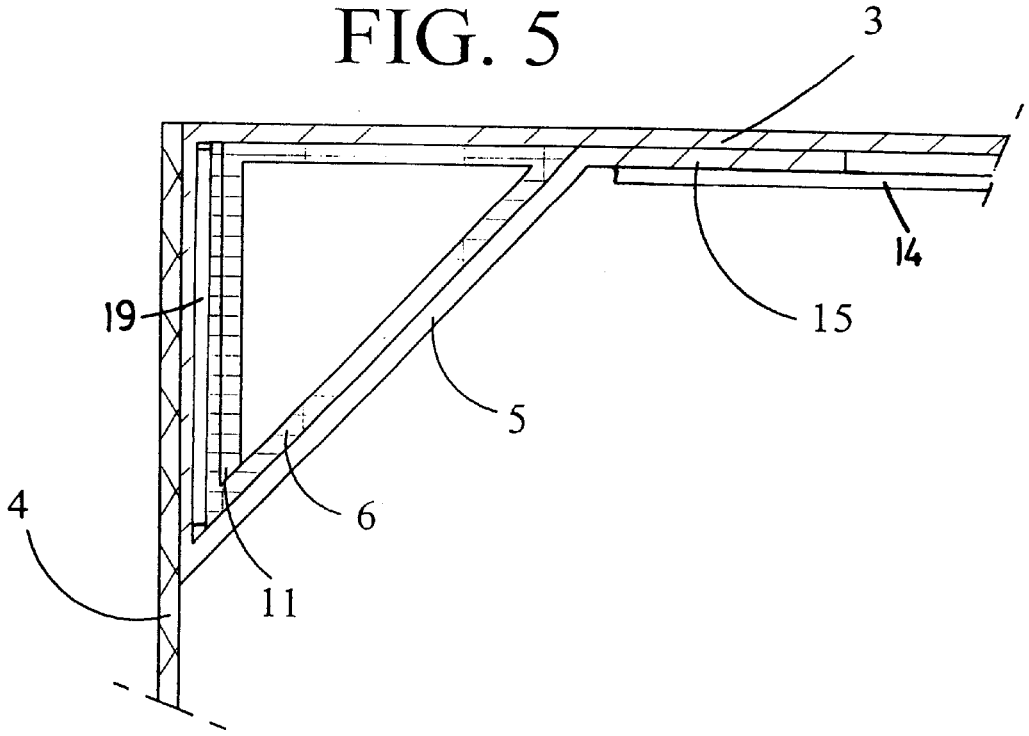
FIG. 5 is a plan view in cross section of one of the columns of the tray of the invention.

FIGS. 4 and 5 show a second embodiment of the tray of the invention. In order to simplify the drawing of FIG. 4, only a fourth part of the sheet 1 is shown. This figure does not show the reinforcing elements, as these are the same as the ones shown in the previous figures. In this second embodiment, the same reference numbers have been used as in the first embodiment for the parts common to both.

The differences with respect to the first embodiment relate mainly to the system of folding of the column 5. The column 5 has a flap 15 that adheres to the larger side 3 of the tray, as may be seen in FIG. 5.

Another difference is the presence of the fold-line 7 that allows folding of the tray at its smaller side 4. FIG. 4 also shows the projections 8 on the sheet 1, which together with the projections 8 provided on the reinforcing elements 6 facilitate the stacking of several trays.

Each headwall 4 also includes a pair of tabs 19 provided on the ends of it. Each one of these tabs 19 will be inserted into each column 5 between the column and the reinforcing element 5.

When it is desired to use the tray of the invention it will simply be unfolded and the reinforcing elements 6 inserted inside the columns 5 so that the tray has sufficient consistency to withstand the weight of one or more trays stacked on top of it.

Figure 6:
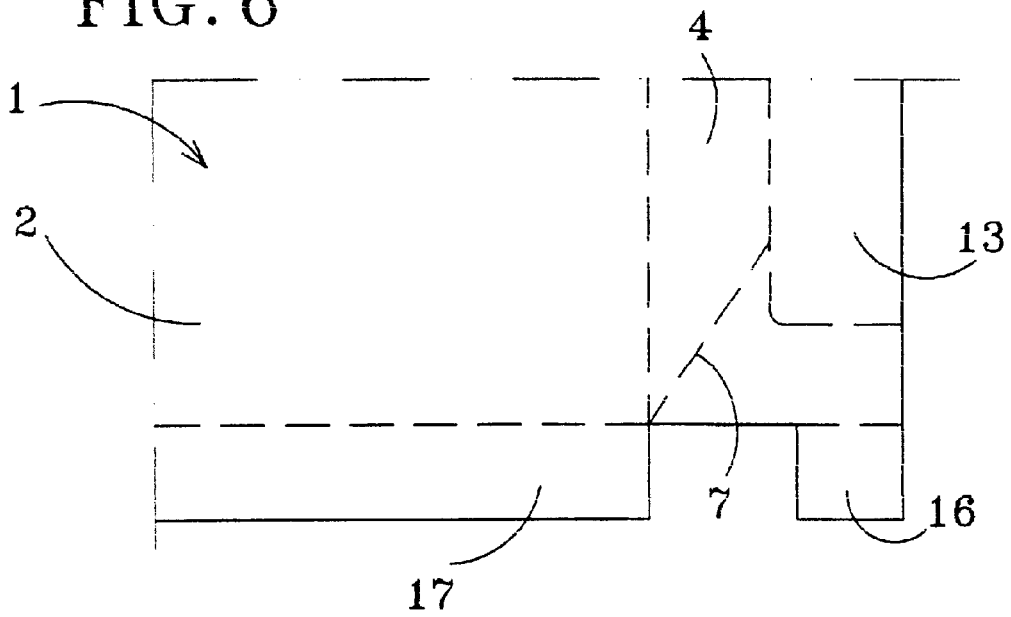
FIG. 6 is a plan view of a fourth part of the main sheet of a third embodiment of the tray of the invention.
Figure 7:
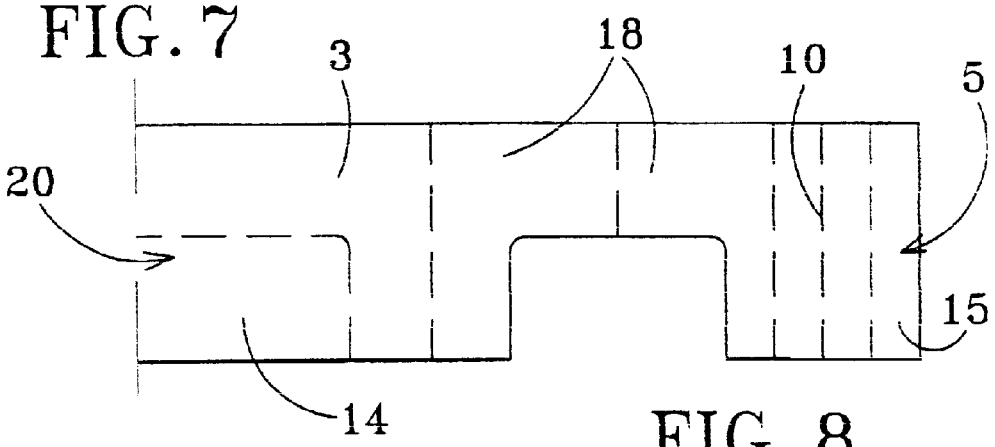
FIG. 7 is a plan view of half additional sheet of the third embodiment of the tray of the invention.
Figure 8:
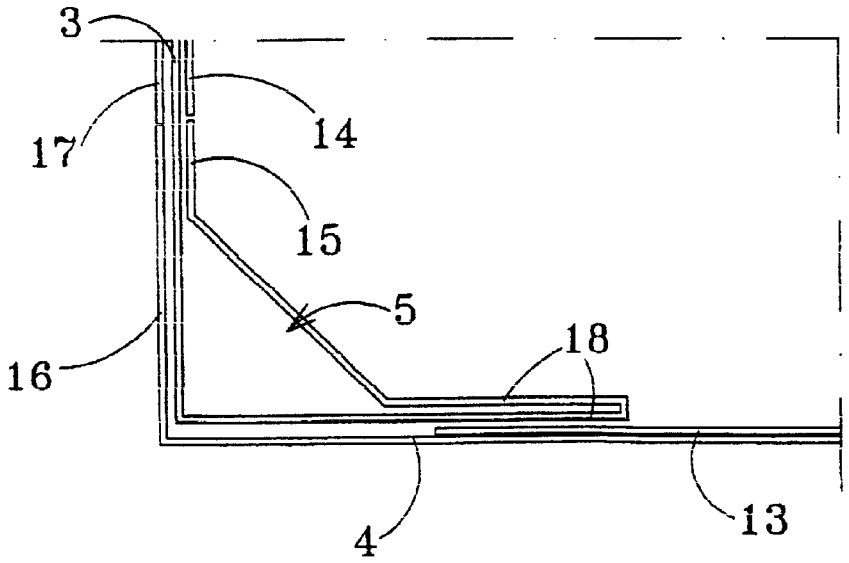
FIG. 8 is a plan view of one of the corners of the third embodiment of the tray of the invention.

FIGS. 6 to 8 show a third embodiment of the tray of the invention. The reinforcing elements are not shown in these figures, as they are the same as the ones shown in the previous figures. In this third embodiment, the same reference numbers have been used as in the first and second embodiments for the parts common to all three.

In this embodiment, the tray of the invention is formed from a main sheet of cardboard 1 and a couple of secondary cardboard sheets 20 that form the side walls 3 of the box.

The main sheet 1 includes some prolongations 16, 17 that reinforce the column 5 with an additional layer.

As FIG. 8 shows in greater detail, the folding of the column 5 is carried out in such a way that it presents a couple of sections 18 that extend towards the centre of the headwall 4, reinforcing it with an additional double layer, so that this part of the headwall 4 has a total thickness of four layers.

In order to simplify the drawing, FIG. 8 does not show the reinforcing elements 6 inside the columns. The reinforcing elements 6 provided in this embodiment are identical to the reinforcing elements 6 of the previous embodiments.

Again, in this embodiment are not shown the projections on the columns, although it is evident that they may be present on this tray.

The present invention also relates to the method for manufacturing the tray of the invention.

Firstly, the die-cutting and formation of the fold-lines are carried out on the sheet 1 and, in the case of the third embodiment, on the additional sheets 20. This die-cutting and formation of fold-lines will define the bottom of the sheet 2, a couple of side walls 3, a couple of headwalls 2 and a column 5 on each one of the corners of the ready-formed tray.

The columns 5 are then glued and afterwards formed. The side walls 3 and the headwalls are then likewise glued and folded.

Once these stages of the method have been carried out, the external part of the columns 5, which will be in contact with the headwalls 4, is glued.

The side walls 3 are then placed in vertical position and a body is fitted inside the columns 5, pressing the headwalls against the columns 5.

Finally, the reinforcing elements 6 are placed on the bottom of the tray in their flattened position, and the ready-formed tray is folded into its transportation position. This folding can be carried out thanks to the presence of the vertical fold line 10 on the column of triangular cross section and the presence of the sloping fold-lines 7 on two opposite sides of the tray.

Optionally, and depending on the tray being manufactured, after pressing of the headwalls 4 against the columns 5, the tabs 19 are folded inside the columns.

If wished, moreover, before gluing a treatment may be applied to the zones to be glued. This treatment consists in heating these zones in order to achieve better adherence of the glue.

It should be noted that feeding of the sheets in the various stages is transversal, this feeding system being much faster than in the known methods, since feeding of the sheets is usually longitudinal.

Despite the fact that reference has been made to a specific embodiment of the invention, it will be clear to a person skilled in the art that the tray and the method described are susceptible of many variations and modifications and that all the details mentioned may be replaced by other technically equivalent details without departing from the scope of protection of the attached claims.

What is claimed is:

1. Tray for transporting products, said tray being formed from at least one sheet (1) of cardboard, said sheet being die-cut and having fold-lines that define a bottom (2) and a first and second pair of opposed sides (3, 4) of the tray, the first and second pair of opposed sides defining four corners of said tray with each one of the corners of the tray comprising a column (5) of polygonal cross section into which a reinforcing element (6) is inserted, said reinforcing element having a cross section equivalent to the cross section of the column (5), so that said reinforcing element (6) fits inside the column, the cross section of both the reinforcing elements (6) and of the columns (5) being triangular, with at least one side of either the reinforcing elements or the columns having a double layer, characterised in that each one of the columns (5) includes a vertical fold-line (10) and that each one of said first and second pair of opposed sides (3,4) of the tray comprise a couple of sloping folds (7), the folds of one side of said first pair of opposed sides being sloped in opposite direction from the other side of said first pair of opposed sides and the folds of one side of said second pair of opposed sides being sloped in opposite direction from the other opposed side of said second pair of opposed sides.

2. Tray according to claim 1, characterised in that each one of the reinforcing elements (6) is formed from a separate sheet of cardboard, wherein said sheet is folded so that it defines said triangular cross section of said reinforcing element (6).

3. Tray according to claim 1, characterised in that a height of each one of the reinforcing elements (6) is substantially the same as a height of each one of the columns (5).

4. Tray, according to claim 1, characterised in that a height of each one of the reinforcing elements (6) is greater than a height of each one of the columns (5).

5. Tray according to claim 1, characterised in that each reinforcing element (6) comprises at least one projection (8) on an upper part of said reinforcing element and a complementary cavity (9) in a lower part of said reinforcing element (6), whereby when a first and a second tray are stacked one on top of the other the projection of one tray is received within the cavity of the other tray.

6. Tray according to claim 5, characterised in that each reinforcing element (6) includes three projections (8) on said upper part of said reinforcing element, which fit into said complementary cavities (9) provided in the lower part of the reinforcing element (6) whereby when a first and a second tray are stacked one on top of the other the projection of one tray is received within the cavity of the other tray.

7. Tray according to claim 1, characterised in that each one of the columns (5) has at least one projection on an upper part of said column and a complementary cavity provided in a lower part of the column, whereby when a first and a second tray are stacked one on top of the other the projection of one tray is received within the cavity of the other tray.

8. Tray according to claim 1, characterised in that each of the reinforcing elements (6) comprises a double layer on each one of its sides.

9. Tray according to claim 1, characterised in that each one of said first pair of opposed sides (3) include a pair of tabs (19) each one of said tabs being structured and arranged to be inserted between a corresponding one of said columns (5) and a corresponding one of said reinforcing elements (6).

10. Tray according to claim 1, characterised in that the tray comprises prolongations (16, 17) on the sides of the tray that reinforce the columns (5) with an additional layer.

11. Tray according to claim 1, characterised in that the columns (5) extend towards two opposite sides of the tray, reinforcing said opposite sides with a double additional layer (18).

12. Method for manufacturing a tray from at least one sheet (1) of cardboard, characterised in that it includes the following stages:

die-cutting a sheet for forming a tray from said cardboard sheet;

formation of fold-lines on said sheet, defining a bottom of the tray (2), a pair of side walls (3), a pair of headwalls (4) and a column (5) at each one of a plurality of corners of the tray;

gluing of the columns (5);

shaping of the columns (5);

gluing the side walls (3) and the headwalls (4);

folding the side walls (3) and the headwalls (4);

gluing of an external part of the columns (5) which will be in contact with the headwalls (4);

placing the side walls (3) in vertical position;

pressing the headwalls (4) against the columns (5);

placing a reinforcing element (6) in each one of the columns (5); and folding the tray into a transporting position.

13. Method for manufacturing a tray from at least one sheet of cardboard, including the following steps:

die-cutting a sheet for forming a tray from a sheet of cardboard;

forming a plurality of fold-lines on the sheet, the fold-lines defining a bottom of the tray, a pair of side walls of the tray, a pair of head walls of the tray, and a column of triangular cross section at each of a plurality of corners of the tray;

forming a vertical fold-line on each column;

forming two sloping folds on each side wall, the folds of one side wall being sloped in a first direction and the folds of the other side wall being sloped in the opposite directions;

gluing the columns;

forming the columns;

gluing the side walls and the head walls;

folding the side walls and the head walls;

gluing an external part of the columns which will contact the head walls;

placing the side walls in a vertical position;

pressing the head walls against the columns;

placing reinforcing elements in unfolded position on the bottom of the tray; and folding the tray into a transporting position.

14. Method according to claim 13, characterised in that after pressing the head walls against the columns, tabs (19) inserted between each one of the columns (5) and each one of the reinforcing elements (6) are folded inside the columns.

15. Method according to claim 13, wherein each of said gluing steps comprise heating a respective zone to be glued.

* * * * *